US005927962A

United States Patent [19]

Amoros Nollas et al.

[11] Patent Number: 5,927,962

[45] Date of Patent: Jul. 27, 1999

[54] PIEZOELECTRIC MECHANISM FOR GAS LIGHTERS WITH EXTERNALLY CLOSED TELESCOPIC BODY

[75] Inventors: Enrique Amoros Nollas; Marcel Meury, both of Tarragona, Spain

[73] Assignee: LaForest Bic, S.A., Spain

[21] Appl. No.: 08/875,791

[22] PCT Filed: Dec. 4, 1996

[86] PCT No.: PCT/ES96/00233

§ 371 Date: Nov. 5, 1997

§ 102(e) Date: Nov. 5, 1997

[87] PCT Pub. No.: WO97/21255

PCT Pub. Date: Jun. 12, 1997

[30] Foreign Application Priority Data

Dec. 4, 1995 [ES] Spain ..... P9502394
Apr. 4, 1996 [ES] Spain ..... P9601237

[51] Int. Cl.[6] ..... F23Q 7/12

[52] U.S. Cl. ..... 431/255; 310/339; 361/260

[58] Field of Search ..... 431/255, 132; 310/339; 361/260

[56] References Cited

U.S. PATENT DOCUMENTS

| | | | |
|---|---|---|---|
| 3,457,461 | 7/1969 | Steinke et al. | 317/81 |
| 3,486,075 | 12/1969 | Steinke et al. | 317/81 |
| 3,521,987 | 7/1970 | Goto | 431/255 |
| 3,729,639 | 4/1973 | Heinouchi et al. | 310/8.3 |
| 3,829,737 | 8/1974 | Johnsson | 310/339 |
| 3,866,069 | 2/1975 | Ishii et al. | 310/8.7 |
| 3,949,248 | 4/1976 | Duffner et al. | 310/8.7 |
| 4,015,152 | 3/1977 | Mohr | 310/8.7 |
| 4,315,180 | 2/1982 | Kondo et al. | 310/319 |
| 4,422,124 | 12/1983 | Challet | 361/260 |
| 4,608,508 | 8/1986 | Ohnishi | 310/339 |
| 4,786,248 | 11/1988 | Nitta | 431/255 |
| 4,859,172 | 8/1989 | Nitta | 431/153 |
| 5,059,852 | 10/1991 | Meury | 310/339 |
| 5,145,358 | 9/1992 | Shike et al. | 431/153 |
| 5,240,408 | 8/1993 | Kenjiro et al. | 431/153 |
| 5,262,697 | 11/1993 | Meury | 310/339 |
| 5,462,432 | 10/1995 | Kim | 431/153 |

FOREIGN PATENT DOCUMENTS 2 072 820 10/1981 United Kingdom .

*Primary Examiner*—Carroll B. Dority
*Attorney, Agent, or Firm*—Pennie & Edmonds LLP

[57] ABSTRACT

It comprises a telescopic assembly formed by a first internal body (1A) and a second external body (2A–2E), the piezoelectric assembly being housed inside and wherein is fixed a piezoelectric crystal which, when struck by the striker hammer (3) appropriately movably guided within the internal telescopic body (1A), produces the gas lighting spark. The second external telescopic body (2A–2E) is closed externally in order to avoid the incoming of foreign elements which could cause problems to the operation of the mechanism The diametral projections of the striker (3) are actuated by first (25) and second (28) ramps, as well as by longitudinal voids (32) provided in opposite walls of said external telescopic body (2A–2E), said ramps guiding the striker (3) both in the assembly process and in the triggering resetting of said striker.

18 Claims, 12 Drawing Sheets

FIG. 12
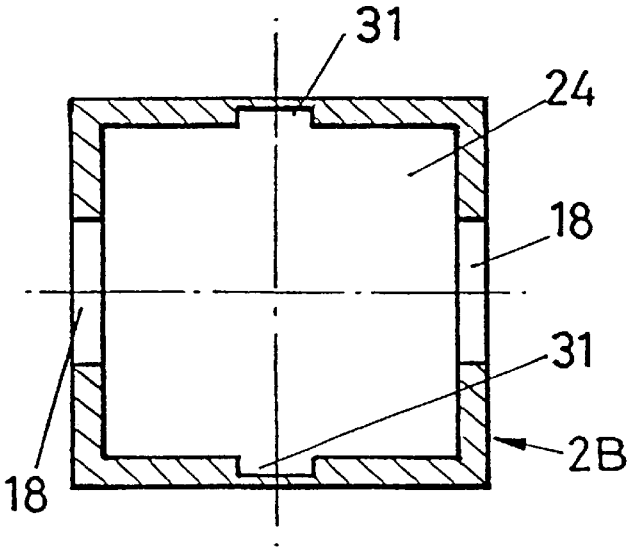
FIG. 13
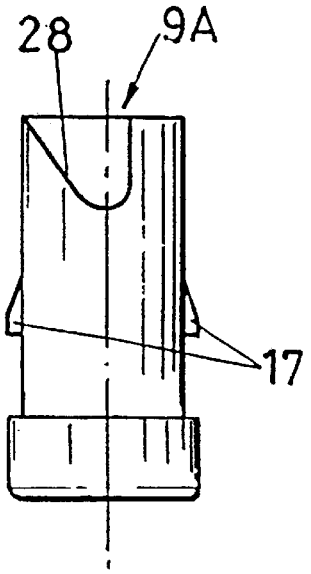
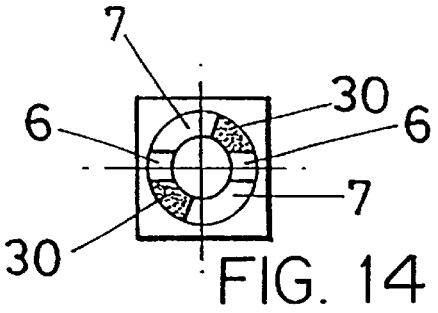
FIG. 14
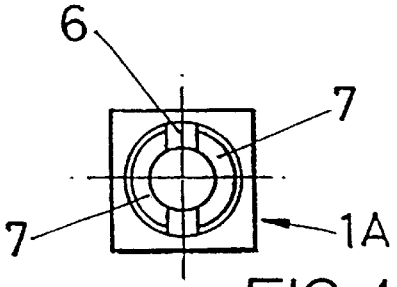
FIG. 15
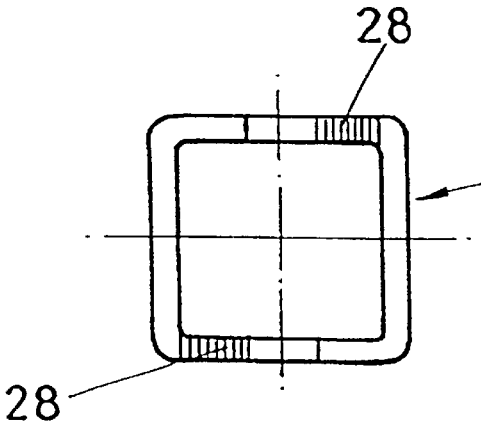
FIG. 16

FIG. 18
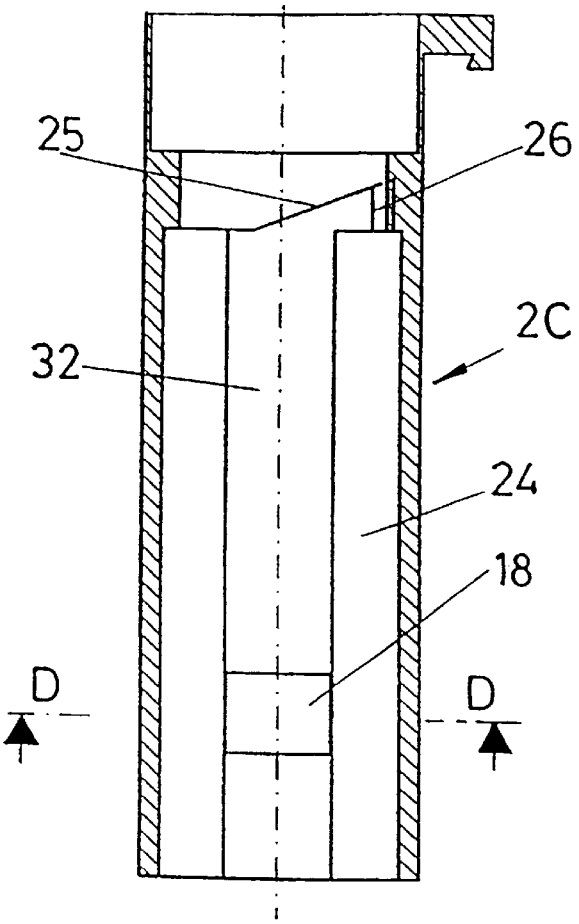
FIG. 19
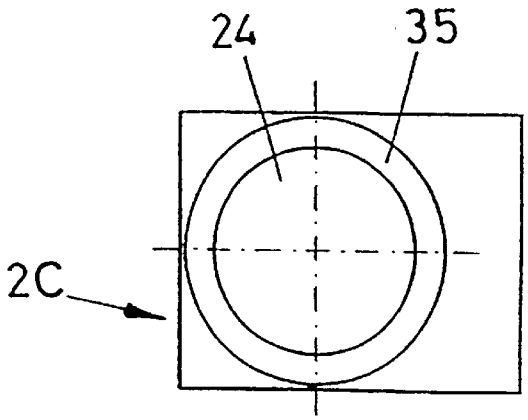
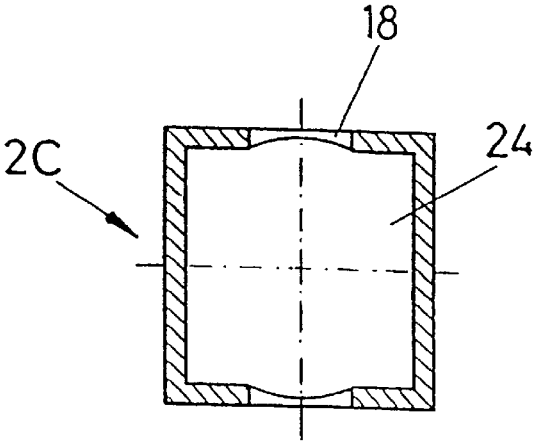
FIG. 21
FIG. 20
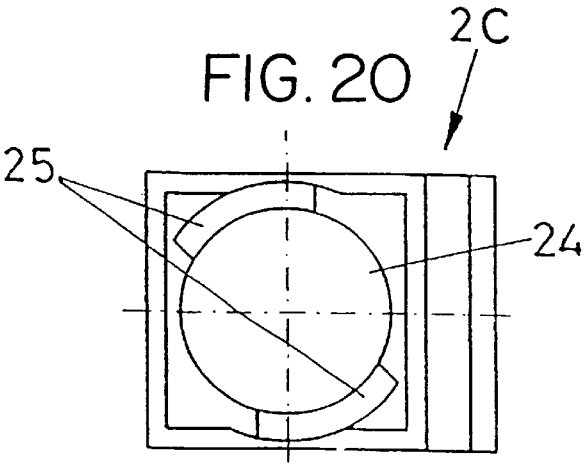

PIEZOELECTRIC MECHANISM FOR GAS LIGHTERS WITH EXTERNALLY CLOSED TELESCOPIC BODY

OBJECT OF THE INVENTION

The present invention, as expressed in the title of this specification, consists of a piezoelectric mechanism for gas lighters, offering notable advantageous characteristics versus conventional ones.

The piezoelectric mechanisms used for the production of the lighting spark, is basically made up of a pair of telescopic bodies which are to be found mutually assisted by a spring which keeps them in the maximum extended position, being equipped with means which limit the total accidental separation. Solidly attached to one of these bodies are indistinctly located the crystal or piezoelectric element which provides the lighting spark when the striker hammer makes impact on the same. The piezoelectric element is in turn found located between a metallic part named "anvil" and another part which is the one which in reality receives the impact of the striker hammer, called "base" or "stop part".

The main object of the invention is constituted by the presentation of an improved shape in the structure of the exterior telescopic body to achieve prevention of the ingress of dust and foreign bodies into the inside of the telescopic assembly in which the actuation mechanisms are enclosed.

BACKGROUND OF THE INVENTION

As is known, in the conventional structure of these pizoelectric mechanisms, the striker hammer plays on the axial hollow of the interior telescopic body, and in the rest position it is found spaced from the piezoelectric element, due to the existence of retention means, will be described hereinafter.

When a manual compression force Is exerted on the telescopic assembly to cause the lighting, which is accomplished by overcoming the action of the spring which assists the telescopic assembly, the compression of a second spring simultaneously takes place, which shall subsequently activate the striker hammer at the moment of release, thus creating the impact energy of the hammer.

The guiding means of the striker hammer are defined by a pair of confronted longitudinal grooves, which run through the wall of one of the tubular bodies, the grooves housing two diametrical projections of the striker hammer.

In the condition of rest of the mechanism, the striker hammer is found retained by its transversal projections, in two notches, each open at a side of the respective longitudinal groove of said tubular body, being inserted in the notches when the striker hammer is forced to effect a rotational movement. In order that the striker hammer performs a small rotation, both for exiting from the retention notches and for entering the same after the impact, to originate the rearming of the mechanisms, at the end of the compression run of the telescopic assembly, and during the distension of the same, respectively, the diametrical projections of the striker hammer are pressed by the ramp edges of two windows provided on the other telescopic body, where said projections also play.

In the U.S. Pat. No. 5,262,697, a mechanism is described of the previously defined type, by means of which a perfect guiding of both telescopic bodies is achieved, having said bodies a totally symmetrical geometry of easy construction, in which the guiding means is external to the position of maximum separation of the telescopic assembly recovery spring and of the spring which activates the striker hammer, which is additionally totally guided throughout its travel.

The mechanism of this Patent, U.S. Pat. No. 5,262,697, achieves the elimination of the induction effects created at the moment when the spark is produced, having been provided that the exterior spring occupies a position which is axially spaced from the piezoelectric element. Likewise, the path of the electric circuit is shortened, with the intervention of the least number of elements possible and it being possible to use nonconductive plastic and to reduce the production costs, as well as achieving a perfect mixing of the gas with the air, prior to the moment when the gas lighting spark is produced, optimizing the combustion. Additionally, the mechanism of document U.S. Pat. No. 5,262,697 also ensures a perfect seating of the hammer on the piezoelectric element by the intervention of a stopping part or base of the striker, so as to achieve greater intensity and sparking time.

The Spanish Patent application P-8902741, describes and claims a piezoelectric mechanism for gas lighters by means of which the elimination of angular movement between both telescopic components is achieved, providing on the exterior body, a pair of projections which act with a key function, playing in the interior of the actual grooves provided on the interior telescopic body for the axial movement of the striker hammer. Due to this, said grooves need to be of greater length than that necessary for the guiding of the hammer. The shortening of the path travelled by the electric current is achieved, since the current only circulatates through the anvil, piezoelectric element, stopping part of the striker hammer and exterior telescopic body, on the contrary to the other previous mechanisms in which the electric current also passes through the springs which assist the striker hammer and the telescopic assembly.

In the piezoelectric mechanisms of the type previously described, the spring which assists the striker hammer, is partially or totally guided inside the telescopic body which houses the striker hammer, abutting its other end on a cover which is attached on the free end of said body, since it is equipped with projections with sawtoothed section, the projections being inserted in respective lateral windows existing on the confronted walls of the telescopic body, becoming immobilized in said fixed position.

Through the windows in the telescopic body with essentially quadrangular transversal section and which houses the striker, in which the diametral projections of the striker are guided, foreign particles, humidity and dust may penetrate, which may produce the obstruction and corrosion of the spring inside the telescopic body, as well as producing pollution and the consequent increase of friction, for example on the ramps on which slide the diametrical projections of the striker slide, apart from the possibilities of generation of parasite electrical currents induced by the presence of dust and/or humidity, all of which may cause a deterioration of the capacity or even result in the impossibility of the generation of lighting sparks, which may also cause a blocking of the mechanism, which is specially hazardous if the blocking is produced when the gas valve is open.

On the other hand, during the assembly process of the piezoelectric mechanisms of the type described in documents U.S. Pat. No. 5,262,697 and EP-A-0172973, the striker must necessarily be inserted in diagonal position into the exterior telescopic body, making it necessary that the interior telescopic body, which is inserted in the axial perforation of the exterior body, requires chamfered ramps on which the lateral striker projections can slide, being forced to effect a small rotation until the grooves or longitudinal guides are reached.

Though it is true that the mechanisms of documents U.S. Pat. No. 5,262,697 and EP-A-0172973 have been the basis of millions of piezoelectric mechanisms with satisfactory results, they imply the forced necessity of a positioning of the projections of the striker in diagonal direction with respect to the exterior telescopic body into which it is previously inserted, as well as the forced requirement of equipping the internal end of the interior telescopic body, with the said positioning ramps during the assembly process of both bodies. This implies a certain complication during the assembly process.

DESCRIPTION OF THE INVENTION

In order to solve the previously refered disadvantages of the known piezoelectric mechanisms, the present invention offers a piezoelectric mechanism for gas lighters, with telescopic body, which is closed to the exterior. Consequently, the exterior telescopic body which conventionally presented open windows towards the exterior and the upper and lower edges of which are inclined to form the ramps which force the rotation of the striker hammer, during the release and the rearming, is replaced by a body which is closed to the exterior, on two interior opposed walls of which, are provided two hollows which present the ramps which guide said striker projections, both in the process of assembly of both telescopic bodies and during the said release and rearming phases of the striker. The upper or first ramps cause the rearming and the lower ramps or second ramps, the release.

The piezoelectric mechanism of the invention comprises a first and a second telescopic body, as well as a first spring which is capable of maintaining both bodies separated from each other at a determined distance. One of the telescopic bodies, fixedly houses a piezoelectric element, whilst inside the interior of the other body a striker is housed, retained in a first position, spaced from the piezoelectric element. Likewise, the mechanism comprises a second spring which impels the striker against the piezoelectric element, means for preventing the relative rotation between the telescopic bodies as well as means for releasing the striker from its first position.

The means for releasing the striker are associated to the telescopic bodies in such a manner that, when sufficient compression force is applied, the two bodies move close to each other and, simultaneously produce the release of the striker from its first position, in such a manner that the second spring may impel the striker against the piezoelectric element with sufficient force so that the impact generates the electric energy for producing a lighting spark. For this, the mechanism also includes means for transmitting the electric energy to electrodes arranged in a combustion chamber.

The first telescopic body or interior body, houses the piezoelectric element assembled between an anvil and a stopping part. The striker is impelled against the stopping part.

The second telescopic body or exterior body, comprises on the interior wall of its internal cavity, a pair of axial hollows as well as ramps which guide the striker. The striker presents an essentially cylindrical shape and two diametrically opposed lateral projections which are guided in the hollows and ramps in the second telescopic body, as well as means for connecting with the second spring.

The means for releasing the striker comprise a lower ramp or second ramp provided in relation with each one of the hollows of the second body, in such a manner that when the telescopic bodies are moved one towards the other during the compression movement, the projections of the striker contact with said second ramps related to the hollows, so as to rotate the striker out of its first position. The hollows also respectively present an upper ramp or first ramp in order to move the projections of the striker back towards their first position when the compression strength is eliminated and the telescopic bodies return to their rest position.

The first telescopic body advantageously presents an axial groove which divides its interior end into two legs presenting curved, transversal sections which, in their exterior part, are essentially complementary to the curvature of at least one section of the axial perforation provided in the second telescopic body. Said groove extends from the interior end of the first telescopic body towards its exterior portion in such a manner that it permits a sufficient travel to allow the axial movement of the diametrical projections of the striker in the release and the recovery of the striker.

Moreover, adjacent to the lower end of the first body, recesses or notches are each provided on diametrically opposed sharp edges. These recesses form retention means in which the diametrical projections of the striker rest in their first position. When the two telescopic bodies are mutually compressed, said projections contact with, and slide on, said second ramps, in such a manner that they exit from said recesses, while, after the release of the striker, said projections reenter into said recesses, to allow the striker to rest in said first position, forced by the first ramps.

According to the invention, said hollows mentioned in relation to the second telescopic body, are provided on opposed walls of the cavity-or axial perforation on the interior part of said second body, and are symmetrical in inverted mirrored image.

Thus, said first ramps are two ramps inclined in opposite directions as regards to each other, provided in diametrically opposite locations on the upper part of the interior wall of the interior cavity of said second telescopic body. The inclination of each one of the two first ramps ascends towards the upper end of the second telescopic body.

The two second ramps are provided on axially opposite position to the first ramps and are inclined in the same direction as said first ramps. Between the ends of said first ramps and the ends of said second ramp essentially parallel, vertical, edges exist which guide the projections of the striker during its movement in the compression phase of the the two telescopic bodies and in the recovery phase of the rest position, after the release of the striker.

The rest position of the striker corresponds with the position in which the diametrical projections of the striker remain in the corner formed on the highest part of the first ramps.

In a preferred embodiment, according to the invention, said opposed interior walls present axial splines in their central part, which start off from one of their ends and end up in said respective hollows. When the striker is inserted in said exterior telescopic body, during the assembly process, it is possible to situate the diametrical projections of the striker, both in diagonal direction as regards the interior cavity of the body, as in orthogonal direction, through said splines. In this latter case, the positioning ramps of the free end of the legs formed at both sides of the longitudinal grooves of the interior telescopic body may also be dispensed with, said positioning ramps beeing the ones with which the striker hammer was forced to perform a rotation, during the assembly, so that the diametral projections of the same were introduced in the longitudinal grooves, rotating once again in opposite direction when they reached the respective retention notches performed at one side in the same rotation direction, achieving the rest position of the mechanism.

In general lines, the improvements introduced in the structure of the mechanism, are directed towards the conservation of the "tight" characteristics of the telescopic assembly, preventing the ingress of foreign particles and humidity into the mechanism which is housed in its interior.

For this, the two hollows located in diametrically opposite zones of the exterior telescopic body, present the characteristics which are herewith defined.

The axial hollows are each made up of an upper ramp section, or first ramp, which forces the projections of the striker to occupy the housing position in the side notches of the longitudinal grooves of the interior telescopic body, during the assembly, and when the extension of the telescopic assembly is produced when the compression force is eliminated, so that the piezoelectric mechanim adquires the rest or recovery position of the initial conditions; other longitudinal sections, or vertical edges of the respective hollow, determine the limits which permit the longitudinal and rotational movement of the striker hammer during the compression and recovery of the telescopic assembly; finally, the fourth section which defines the lower ramp, or second ramp of the hollow, thanks to which the exit of the diametrical projections of the striker is produced for causing the impact on the crystal at the end of the compression of the telescopic assembly, is located at the internal edge of the cover which closes the lower end of the exterior telescopic body.

The lower ramps, or second ramps, may be provided directly on the internal wall of the exterior telescopic body, or else, may form part of the cover which is applied to close the exterior end of the same. A cover with ideal characteristics for the present invention, is described and represented for example, in the U.S. Pat No. 5,262,697, the contents of which are included in the present description for express reference.

The curvatures in horizontal projection of the ramps correspond to segments of a major circular crown, concentric to a circular transversal section of the interior axial cavity of the exterior telescopic body.

The diameter of the circular crown segments of the curvatures of the ramps, is sufficiently superior to the extension between the diametrical projections of the striker, to facilitate the free rotation of said projections on said ramps.

According to an embodiment of the invention, the interior cavity of the exterior telescopic body presents a substancially quadrangular interior transversal section, from its lower end or exterior end of the telescopic assembly, to approximately the horizontal plane of the lower ramps, and subsequently a circular section to its upper end, or interior of the telescopic assembly. In this case, the extension of the diagonal between the corners of the quadrangular part of the cavity is sufficiently wide to permit the diagonal insertion through the base of the exterior end of said body and the free movement of the diametrical projection of the striker towards the upper ramps, or second ramps. In this case, the ends of the legs formed on the first telescopic body present a chamfer, which, during assembly, contacts, on insertion of said first body or telescopic interior body, into the second body or exterior telescopic body, with the diametrical projections of the striker and causes an approximate 45° rotation of the same, confronting the projections with the grooves defined between the legs, thus guiding said projections on the internal edges of the legs and subsequently, in a new 45° rotation in opposite direction to the former, housing the projections into the side notches provided on said legs.

According to another embodiment of the invention, the interior cavity of the second telescopic body presents two vertical splines which essentially extend through the centre of two opposite sides of the interior cavity, from the exterior end of the second telescopic body to the plane of the second ramps or inferior ramps. The distance between the bottom parts of the two splines permit the insertion and sliding of the striker up to the second ramp, guiding the diametrical projections of the same in said splines. In this case, it is not necessary that the ends of the legs formed on the interior telescopic body, be equipped with the previously indicated positioning chamfers, since, on assembly of the first telescopic body into the second, it is not necessary that the striker performs the two previously described rotational movements to house into the notches provided on the legs of the first telescopic body. On the other hand, in this embodiment, the lower section of the axial perforation of the second telescopic body, may be cylindrical, its transversal section being at least as wide as the first section of said perforation on which the hollows, comprised of the previously indicated guides and the ramps, are to be found.

In a preferred embodiment of the invention, means are provided, which prevent the relative rotation between both telescopic bodies, defined by an angular "L"-shaped part, according to what is also described in the U.S. Pat No. 5,262,697.

In an alternative embodiment, the first ramps, or upper ramps of each one of the two diametrically opposed axial hollows, and/or the vertical guides or longitudinal edges of the same, are established on an independent section of the exterior telescopic body, which is connected to the rest of the same.

In a perferred embodiment, the lower ramps or second ramps and the vertical guide sections, are included on two opposite walls of the cover which closes said second body, said cover being provided with a tubular section which penetrates through the mouth of said second body. On the interior free end of said penetrating tubular section, two notches exist, established on opposite walls, in such a manner, that the upper end of the cover almost reaches the lower end of the first ramps formed in the upper part of said exterior telescopic body which is being considered at present.

The lower cover may have a short neck which penetrates through the lower mouth of the body, counting only with the notch which makes up the lower ramp of the hollow, one on each side.

In another alternative embodiment, the upper part of the exterior telescopic body is also detachable and independent from the remainder, joining with said remainder, due to the fact that it has a tubular extension which is inserted through the upper mouth of said remainder. Similarly to what has been indicated for the cover on the lower part, the lateral wall of said remainder, includes on two opposite points, windows through which are inserted the teeth provided in correspondence, on the exterior of the tubular extension of said detachable terminal part.

This detachable part, upper and independent from the exterior telescopic body, is foreseen to include the first ramps as well as the vertical or lateral guides of the longitudinal hollows, due to which, its neck which penetrates through the mouth, is rather long, since it practically reaches the internal end of the lower cover which, in this case, only includes the second ramps, or lower ramps.

It has also been foreseen, according to the present invention, that the upper and independent part of the second body, shall only include the first ramps, the upper part being of shorter length and its internal mouth practically reaching the plane where the vertical guides start, the same existing in the second body and carried out jointly with the respective lower ramps. Since said detachable upper part exists, the rest of the body is constructed of one single part, the confronted longitudinal hollows being open on their upper part.

In order to make more comprehensible the characteristics of the invention, and forming an integral part of this specification, a series of drawing sheets are attached, in which figures, with an illustrative and non limitative character, the following has been represented:

BRIEF DESCRIPTION OF THE DRAWINGS

FIG. 12 is a cross sectional view, taken along line C—C of FIG. 11.

FIG. 13 is a side elevation view of the cover, according to a second embodiment, which is inserted in the base of the telescopic body of FIG. 11.

FIG. 14 is a bottom plan view of the first telescopic body, or interior telescopic body, of FIG. 4.

FIG. 15 is a bottom plan view of the interior telescopic body of FIG. 5.

FIG. 16 is a exploded plan view of the covers represented in FIGS. 8 and 13.

FIG. 18 is a sectioned longitudinal elevation view of the upper part of the same exterior telescopic body of FIG. 17.

FIG. 19 is a plan view of FIG. 18.

FIG. 20 is a bottom plan view of FIG. 18.

FIG. 21 is a section taken on line D—D of FIG. 18.

DESCRIPTION OF THE PREFERRED EMBODIMENT

Figure 1:
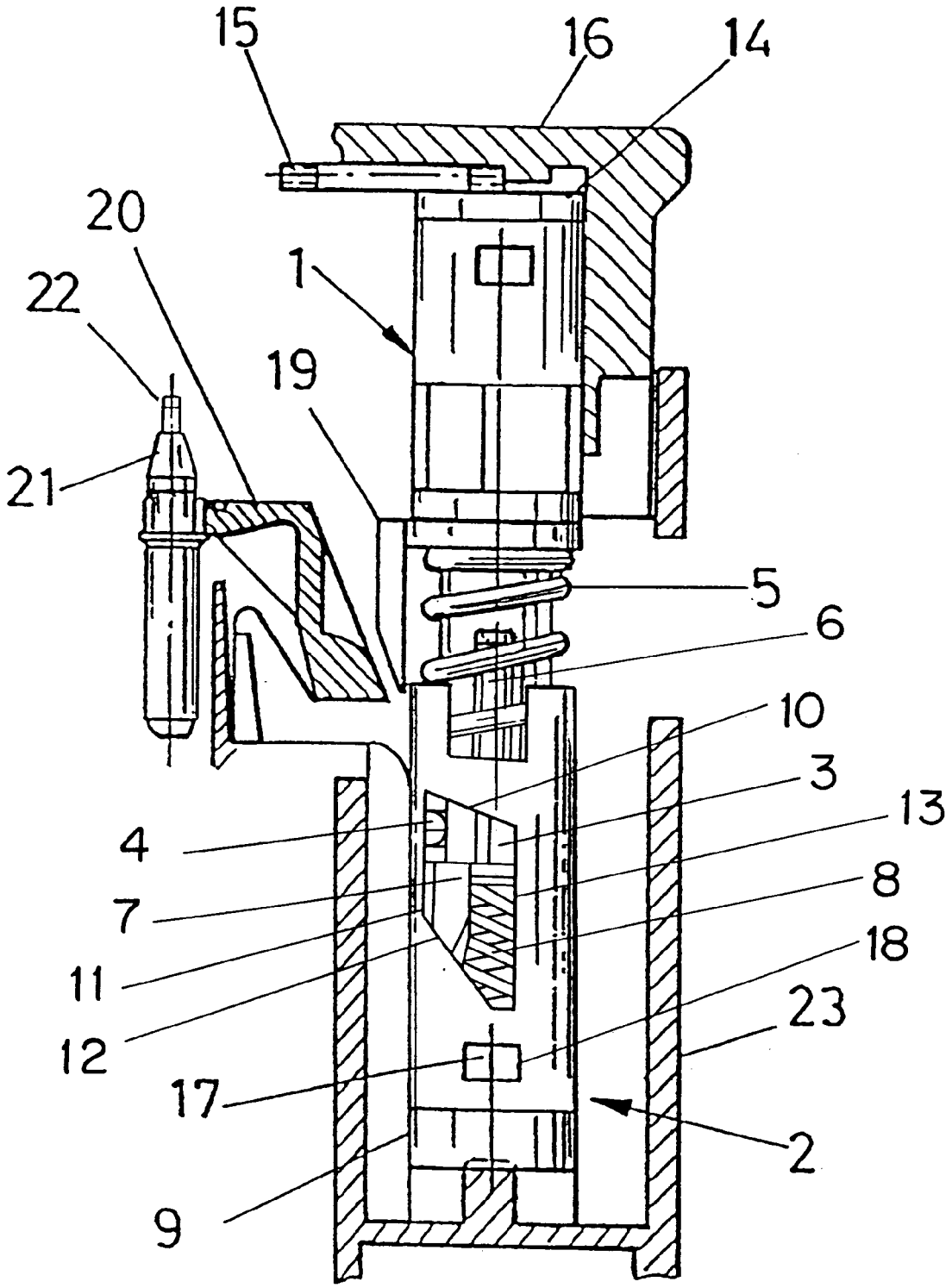
FIG. 1 is a longitudinal elevation view of a piezoelectric mechanism for gas lighters, which corresponds to the previous state of the art, and more specifically, the one corresponding to the United States Patent of Invention U.S. Pat. No. 5,262,697, of the same applicant Company, in armed position and located inside the body of the lighter, the latter being represented partially and sectionally.

Making reference to the numbers adopted in the figures, and especially in relation to FIG. 1 in which an example of the previous state of the art is represented, it can be observed that in this type of piezoelectric mechanisms there exists an interior telescopic body or first telescopic body 1 and an exterior telescopic body or second telescopic body 2, which make up the telescopic assembly inside of which the components of the mechanism are assembled, and which are described hereinafter. In the position represented in FIG. 1, the telescopic assembly is mounted and in a rest position, as is also the activating mechanism of the striker 3 provided with the diametrical projections 4. Reference 5 designates the helicoidal spring for the recovery of the extended position of the telescopic assembly 1–2.

The interior telescopic body 1 has in its internal part, as regards the exterior telescopic body 2, a tubular cylindrical configuration in which the striker hammer 3 is guided. The diametrical projections 4 of the striker hammer 3 play in respective longitudinal grooves 6 established according to two opposed generatrices, open at the bottom, establishing two longitudinal legs 7. The striker hammer 3 is assisted by the release spring 8 which is guided in the same axial hollow of said interior body 1 and in the axial hollow provided to that effect in the exterior telescopic body 2, and the lower end of which abuts on a cover 9 which covers the lower base of said body 2.

In the rest position, the two diametrical projections 4 of the striker 3 are housed in the side notches of the longitudinal legs 7, as has been previosuly indicated. In this position, due to the pressure exerted by the spring 8, the projections 4 also remain pressed against the upper corners of each of the recovery ramps 10, inclined and defining the upper edge of each of the trapezial windows provided paracentrally on opposed walls of the exterior body 2, as is clearly shown in FIG. 1.

The windows are respectively formed by said upper ramp 10, a first vertical section 11, another lower or release ramp 12, and another vertical section 13, the lower angle of said window being shot as can be observed in FIG. 1.

The conventional piezoelectric assembly is found on the upper part of the interior body 1, made up of the actual piezoelectric crystal, the anvil 14 and a stopping part on which the striker hammer directly impacts, neither the base part nor the piezoelectric crystal arranged in intermediate position being represented in this figure. The anvil 14 is electrically connected to a first electrode 15 which emerges towards the combustion chamber (not represented), the spark being produced on activation of the pushbutton 16.

On the other hand, we have seen that the exterior telescopic body 2 is closed on its bottom by cover 9, which is attached by means of two opposed projections 17, which house in complementary windows 18 of the walls of body 2. The release ramp 12, instead of being formed on the wall of body 2, may also be provided by means of chamfers on each of the ends of the internal upper part of cover 9.

On compression of the piezoelectric mechanism, the lower part of body 1 penetrates into the cavity of body 2, carrying with it, the striker 3 until its projections 4 are deviated by the respective release ramps 12, until projections 4 exit from the notches of legs 7 in order to impact against the base of the piezoelectric assembly, by the action of the release spring 8. During the shortening phase of the telescopic assembly, the recovery spring 5 is compressed. In this phase it also happens, that the vertical wing of the angular part 19 forming part of the interior telescopic body 1, angularly moves cam 20 which opens the gas valve 21 in which the second lighting electrode 22 is to be found.

When striker 3 impacts against the stopping part of the piezoelectric assembly, an electric energy is generated which produces the bursting of the lighting spark between electrodes 15 and 22, lighting the gas released by the gas valve 21. Reference 23 designates the shell of the lighter, shown in exploded view.

Figure 6:
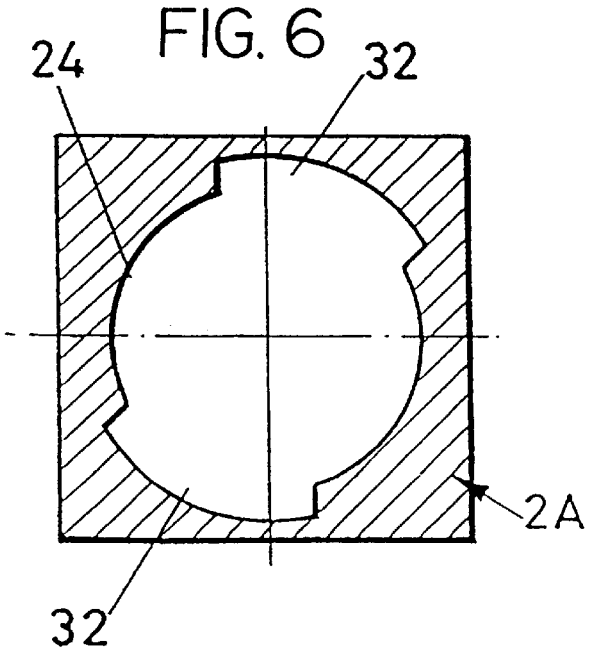
FIG. 6 is a cross sectional view, taken along line A—A of FIG. 3.
Figure 7:
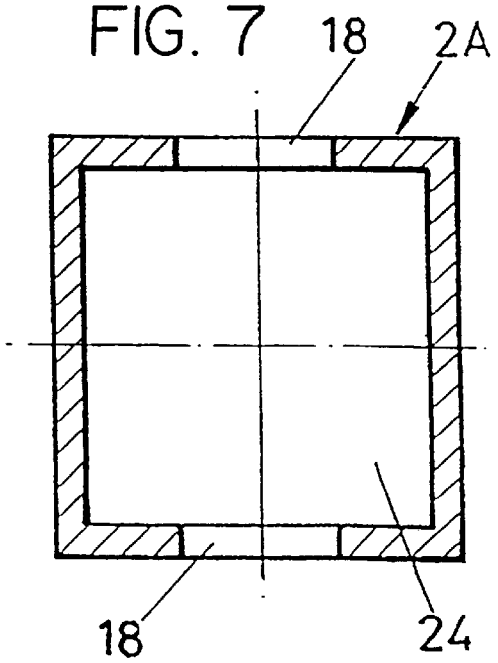
FIG. 7 is a cross sectional view, taken along line B—B of FIG. 3.

Making special reference herewith to FIGS. 3, 6, 7 and 10, the exterior telescopic body is represented, in its first embodiment according to the present invention, being referenced with 2A. The lower part of the interior cavity 24 of body 2A, presents a substantially quadrangular cross section (FIG. 7), while that of its upper part is essentially circular (FIG. 6). In the interior walls of the upper part of body 2A, there are two diametrically opposed hollows, in which the ramps are constructured which act on the the projections of the striker 3. More specifically, the first ramp or upper ramp 25 as well as the vertical edges 26 and 27 are configured by said longitudinal hollows. The second ramp, lower ramp or release ramp, is formed in this case in the edge of the lower cover 9 which closes the mouth of said exterior telescopic body 2A, this lower ramp being referenced with number 28. Two ramps naturally exist on two opposed walls. It must be noted, that the lower part of body 2A also presents the windows 18, diametrically opposed, of the conventional body of FIG. 1. Evidently, said windows 18 may be replaced by hollows in the axial cavity wall 24 of the telescopic body 2A.

Figure 4:
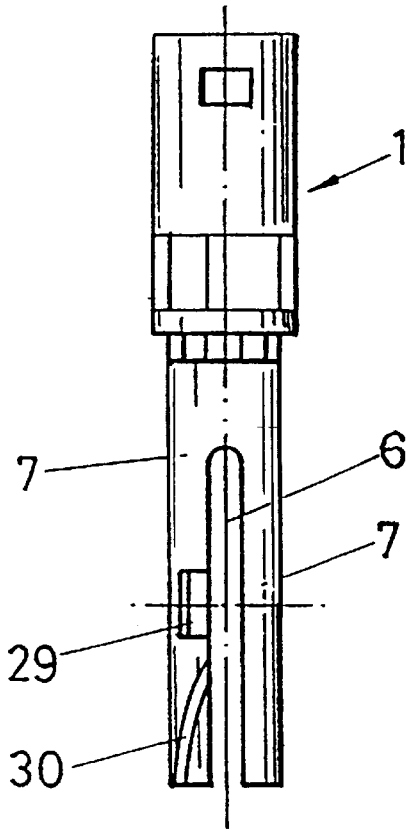
FIG. 4 is a side elevation view, of the interior telescopic body, according to a conventional embodiment.

In FIG. 4 it is observed how the lower part of interior body 1 of the telescopic assembly is provided, on its legs 7, with the side notches 29 for housing the diametrical projections 4 of striker 3. In this same FIG. 4, the lower ends of legs 7 of the conventional telescopic body 1, each additionally present chamfers 30 the function of which is described hereinafter, while the interior telescopic body 1A of FIG. 5 lacks said chamfers.

Figure 8:
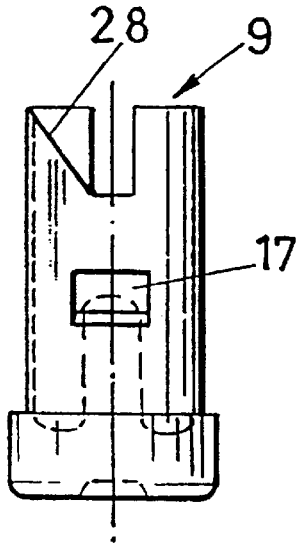
FIG. 8 is a side elevation view of the cover, according to a conventional embodiment, which is inserted in the base or interior end of the exterior telescopic bodies of FIGS. 1 and 2.

FIGS. 8, 13 and 16, show in greater detail, the release ramps, that is to say, the second ramps or lower ramps 28 provided on cover 9 which must remain attached to the lower mouth of conventional body 2, as in the one represented by the invention, referenced with 2A.

Figure 9:
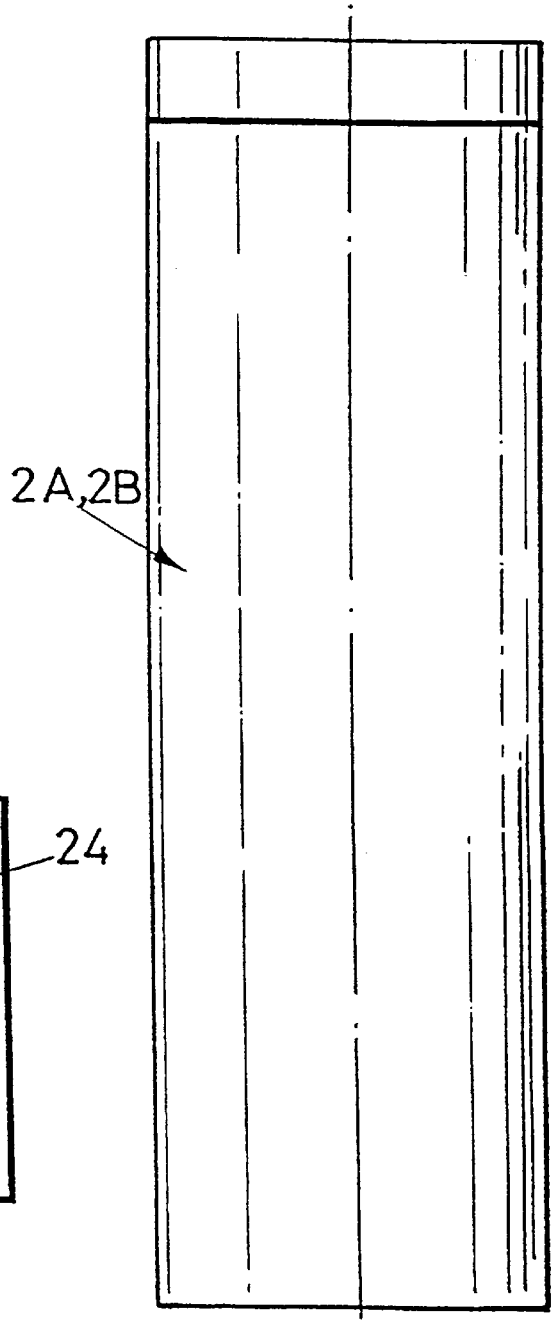
FIG. 9 is a side elevation view of the exterior telescopic body, according to the invention.

FIG. 9 shows that, on the contrary to the conventional exterior telescopic body 2, the exterior body 2A does not present conventional windows, consequently remaining totally tight.

Figure 10:
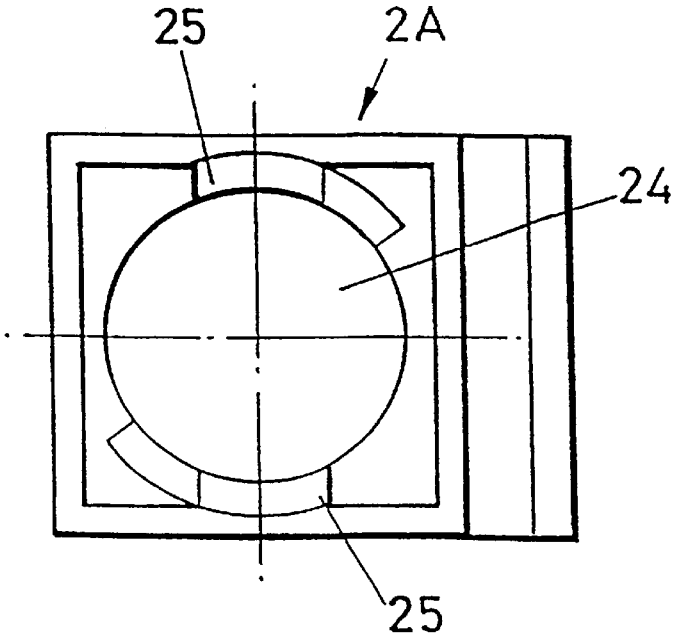
FIG. 10 is a section taken along line A—A of FIG. 3, from-the bottom part.

In FIG. 10 may be observed the recovery ramps or upper ramps 25 as well as the axial cavity 24. On the outside, ramps 25 are delimited by the material of telescopic body 2A, in such a manner that, they form in cross section, the segments of a circular crown which is concentric to the circle presented by the cross section of said cavity 24.

Figure 2:
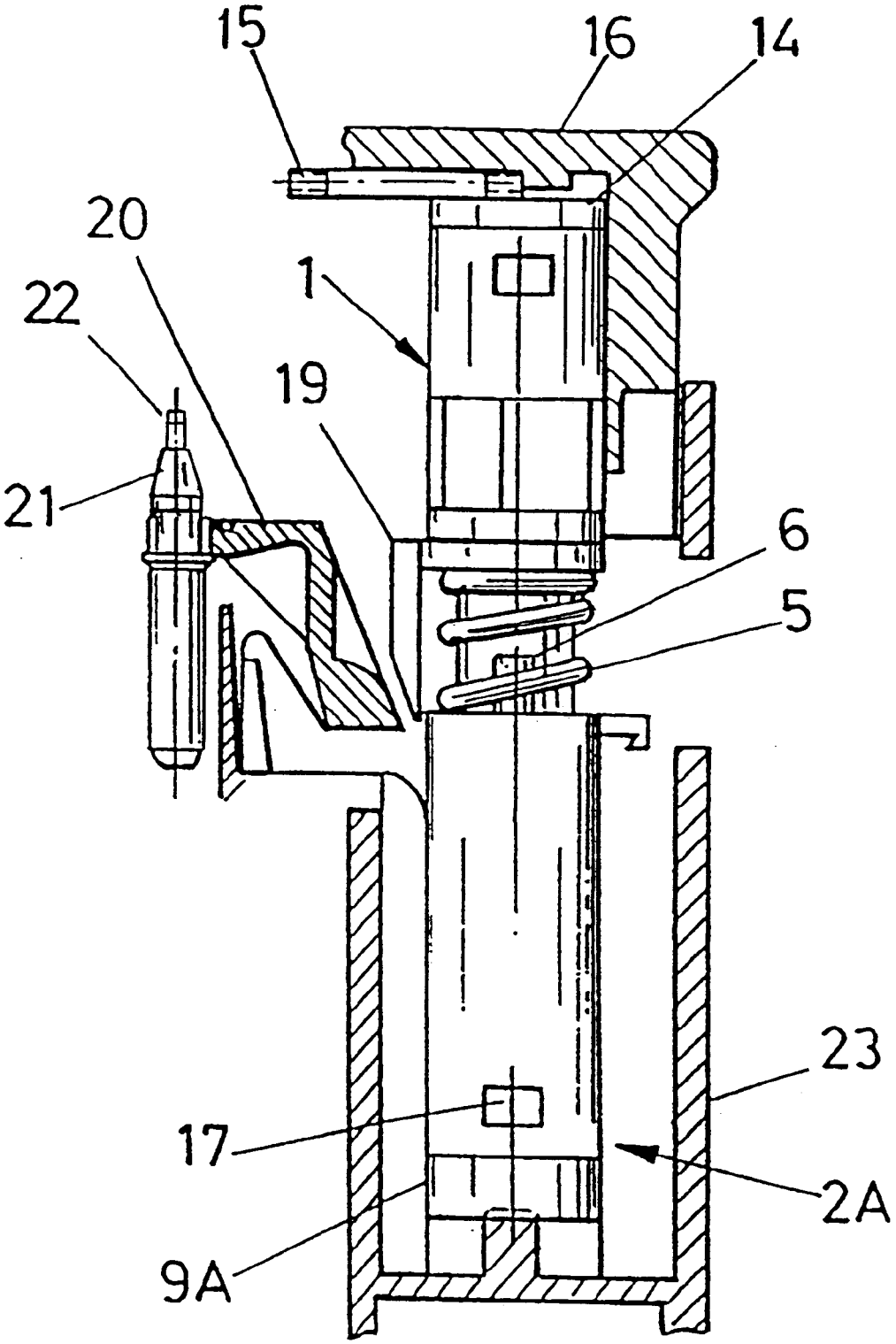
FIG. 2 is a view similar to FIG. 1, of a piezoelectric mechanism for gas lighters, according to the present invention, in armed position and located inside the body of the lighter, the latter being represented partially and sectionally.
Figure 3:
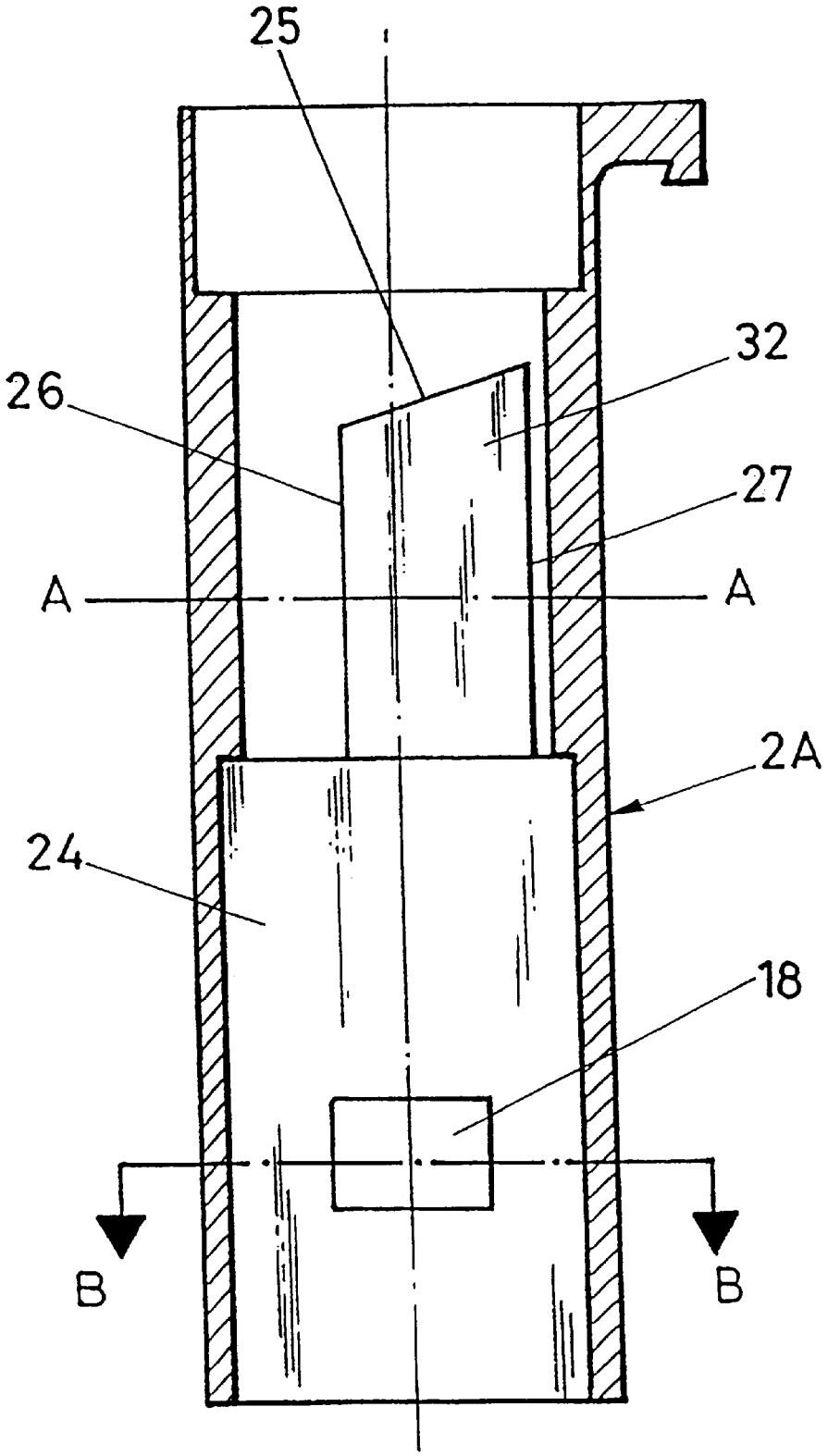
FIG. 3 is a sectioned longitudinal elevation view of a first embodiment of the second body or exterior telescopic body, according to the invention.

FIG. 2 represents the same elements as FIG. 1, with the exception of the exterior telescopic body which is to be found laterally closed to the exterior.

Figure 11:
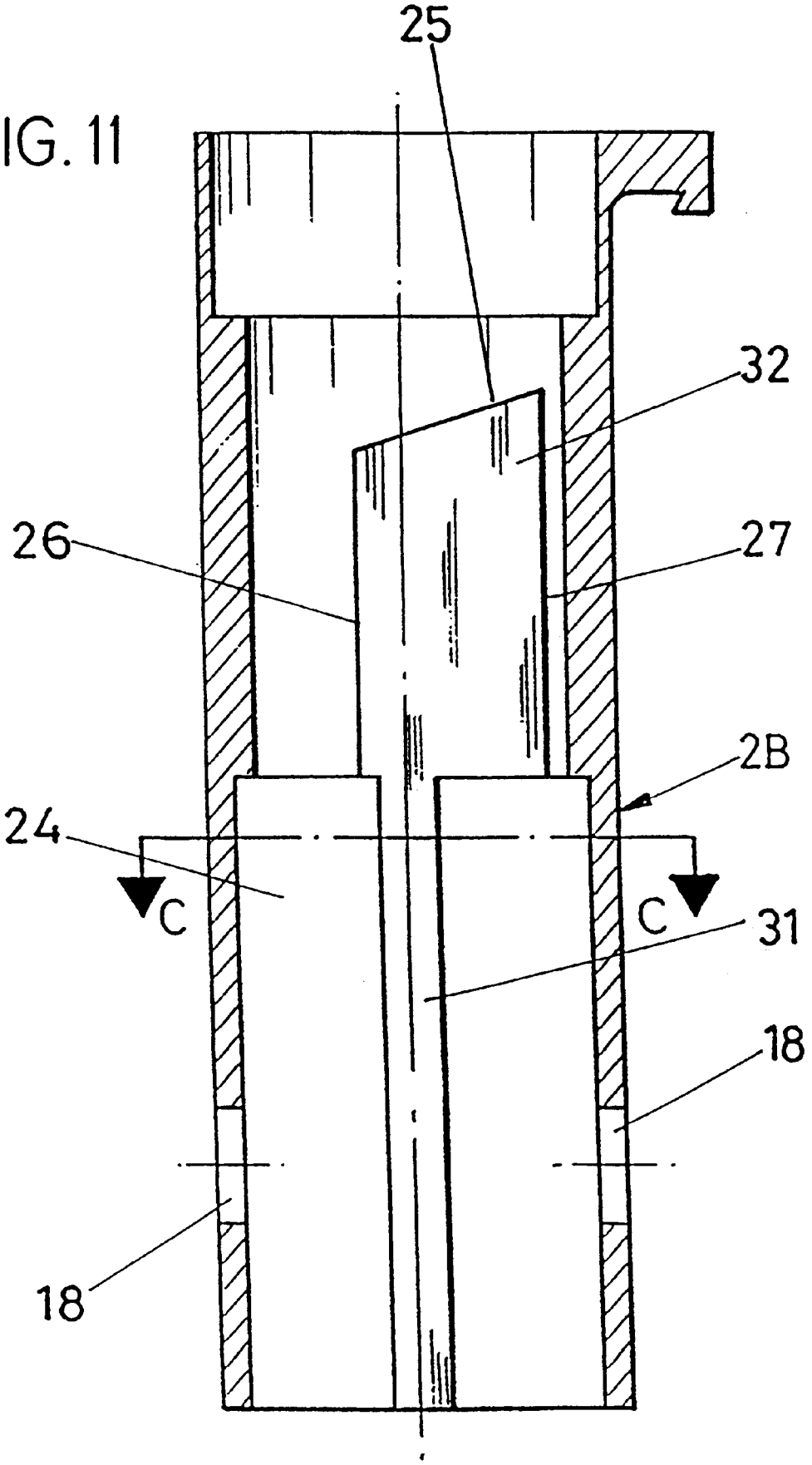
FIG. 11 is a longitudinal elevation sectional view of a second embodiment of the exterior telescopic body, according to the invention.

In FIGS. 11 and 12 may be observed the most relevant details of the second embodiment of the exterior telescopic body 2B where the striker 3, during the assembly process, is not inserted with its diametrical projections 4 placed diagonally as regards the external base of the telescopic body, but through the splines 31 arranged axially on opposed walls of axial cavity 24 which lead to respective confronted hollows of the telescopic body 2B. These hollows which configure the vertical edges 26 and 27, as well as upper ramps 25 and lower ramps 28, are referenced with number 32. In this case, the striker projections 3 are kept in "orthogonal" position until they reach upper ramps 25 for recovery of the rest position.

In this embodiment of FIG. 11, the telescopic body 2B has windows 18 (or recesses which do not completely penetrate the wall of the telescopic body), arranged contrary to the position occupied by windows 18 of the exterior telescopic body according to embodiment 2A, consequently being arranged on the walls of telescopic body 2B on which the hollows 32 are not present, to avoid interference with splines 31. Consequently, for the attachment of cover 9 on telescopic body 2B, according to what may be appreciated in FIG. 13, attachment projections 17 of cover 9 are also arranged on walls adjacent to those which present the release ramps or lower ramps 28.

According to an alternative embodiment, the axial hollow 24 is cylindrical all throughout body 2B.

The operation of the release and the recovery of the rest position of striker 3, in embodiments 2A and 2B of the telescopic bodies, is analogeous to that of the previous operation described in the conventional mechanism of FIG. 1.

Figure 5:
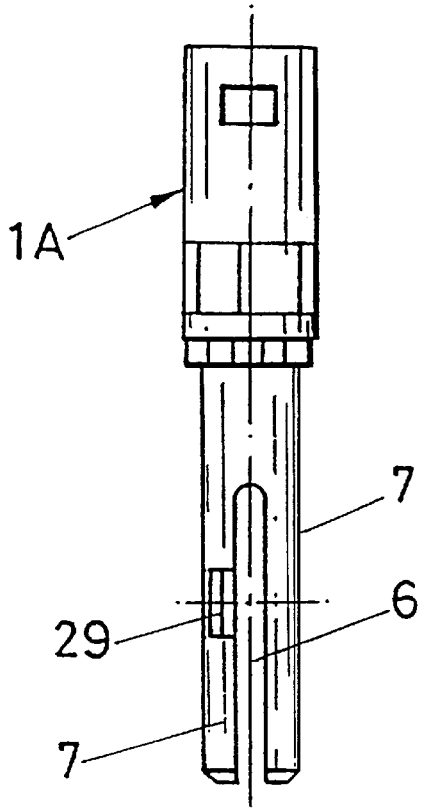
FIG. 5 is a side elevation view of the interior telescopic body, according to an embodiment of the invention.

For the assembly of the telescopic mechanism which comprises the exterior telescopic body according to embodiment 2A, the conventional interior telescopic body 1 provided with chamfers 30 is used, which is represented in FIGS. 4 and 14, whilst, when dealing with telescopic body 2B, telescopic body 1A may be indistinctly used, represented in FIGS. 5 and 15 and which does not present said chamfers.

In the case of body 2A striker 3, release spring 8 and cover 9 are assembled on the exterior telescopic body 2A. Subsequently, legs 7 surrounded by the recovery spring 5 of telescopic body 1, 1A, already provided with the piezoelectric elements as well as with the previously described angular part, are inserted through the upper base of telesocpic body 2A, in such a manner, that the axial groove 6 remains aligned between the hollows 32. On insertion of the interior telescopic body 1, its chamfers 30 move projections 4 of the striker 3 towards the centre of the hollows 32, in an approximate 45° rotation in such a way, that said projections are introduced inside the axial groove 6 of telescopic body 1 until they house inside notches 29 performing an inversed 45° rotation forced by the action of release spring 8 which pushes the striker towards the interior base of the telescopic body and consequently against the ramp for the recovery of the rest position, or upper ramps 25. Thus, the two telescopic bodies 1, 2A remain joined, forming the assembled piezoelectric mechanism.

The exterior telescopic body 2B may be indistinctly joined to conventional interior telescopic body 1, or to telescopic body 1A represented in FIGS. 5 and 15. When body 2B and 1 are assembled, the process is practically identical to the assembly of previously described bodies 2A and 1.

When the exterior telescopic body 2B and the interior telescopic body 1A are assembled, body 1A, provided with recovery spring 5 and with the piezoelectric elements, is inserted first inside body 2B, in such a manner, that axial groove 6 of body 1, remains aligned with splines 31 of body 2B. Thus, the recovery spring 5 is progressively compressed. Subsequently, the striker 3 is inserted so that its diametrical projections 4 enter inside splines 31 of body 2D. Next, the release spring is introduced and finally the cover (9). Thus, the diametrical projections 4 of striker 3 enter inside axial groove 6 of body 1A. When cover 9 is assembled, the release spring 8 remains compressed between the cover and the striker. Then, one ceases to push body 1A towards body 2B and, consequently, the recovery spring 5 expands and separates bodies 2B and 1A. When during the progressive distancing of bodies 1A and 2B projections 4 remain aligned with side notches 29 of body 1A, said projections 4 slide, forced by the pushing force of release spring 8, on the upper ramps 25 and perform a 45° rotation to become housed inside said notches 29. In this manner, the two telescopic bodies 1A and 2B remain joined, forming the assembled piezoelectric mechanism.

Now, making special reference to FIGS. 17 to 25, which consider another alternative embodiment of the exterior telescopic body, it may be observed that the same is referenced generally with number 2C. In this case, said body is only provided with upper ramp 25 in each one of its opposed hollows 32, the lower ramp 28 and the side edges of said longitudinal hollows 32, being arranged on the cover 9B itself.

The cylindrical hollow of cover 9B is referenced with number 33 (FIG. 23) and the same is housed and guided the cylindrical interior end of telescopic body 1. Reference 34 represents the coaxial spigot for guiding the release spring 8.

Figure 17:
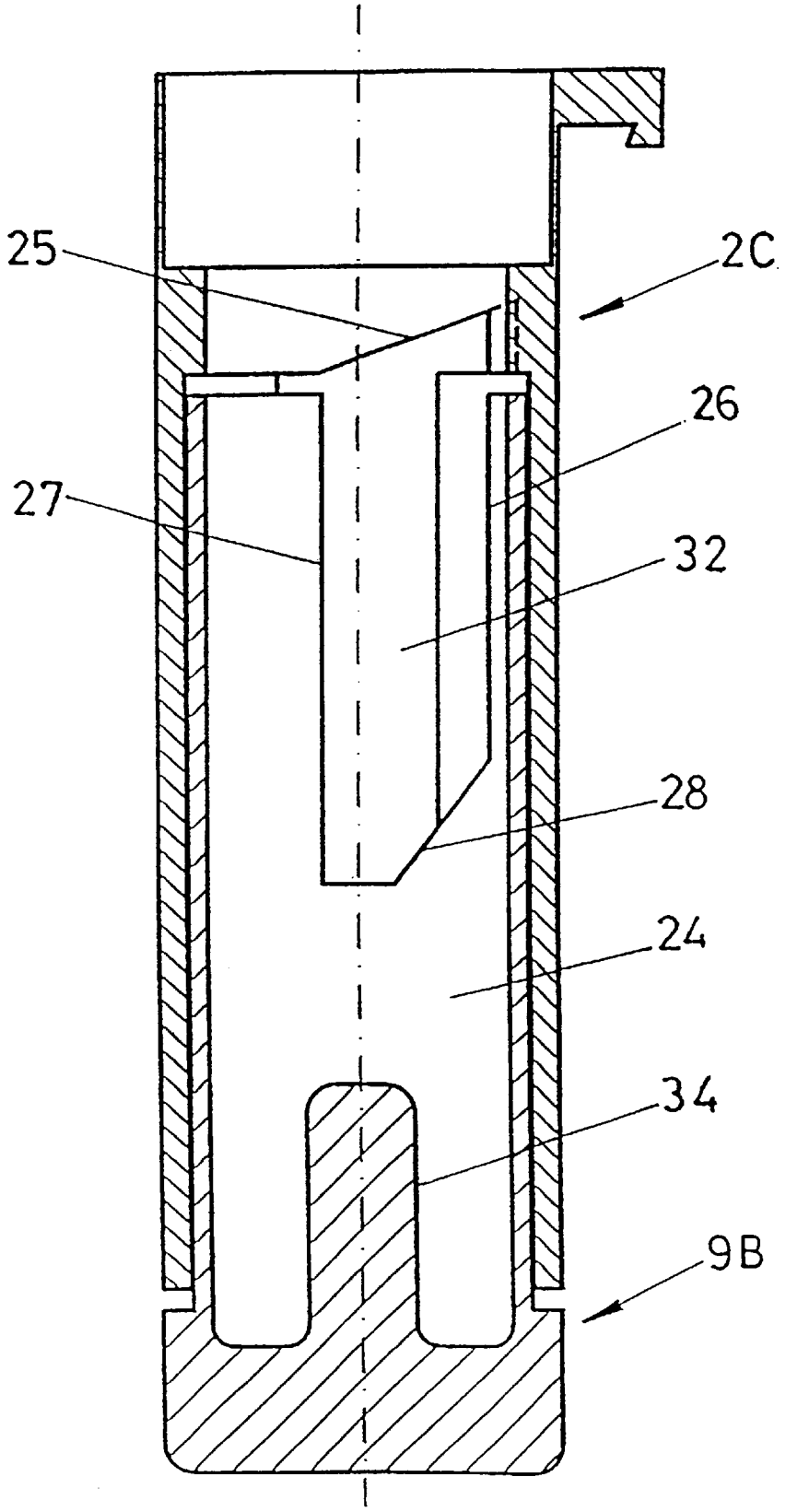
FIG. 17 is a sectioned longitudinal elevation view of the exterior telescopic body of the piezoelectric mechanism, according to a third embodiment of the present invention, the two parts which make up the body being coupled.
Figure 22:
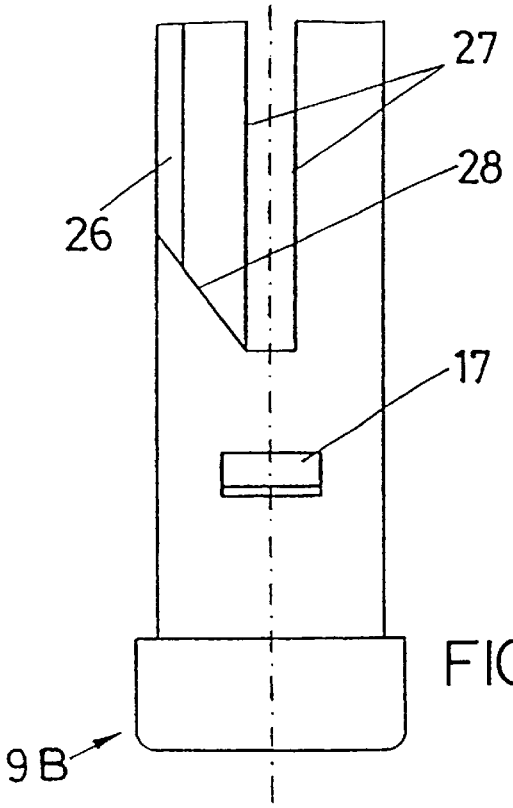
FIG. 22 is a longitudinal elevation view of the cover which closes externally, the exterior telescopic body and which makes up the other part of the same body of FIG. 17.
Figure 23:
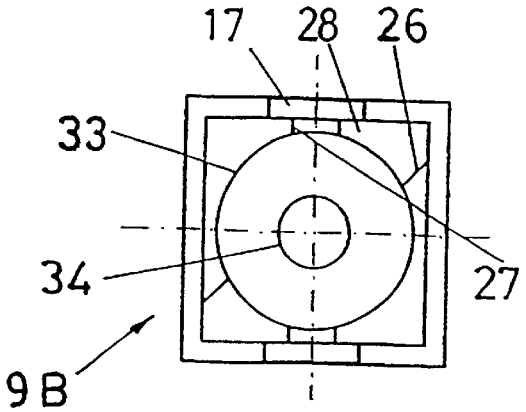
FIG. 23 is a plan view of what is shown in FIG. 22.
Figure 24:
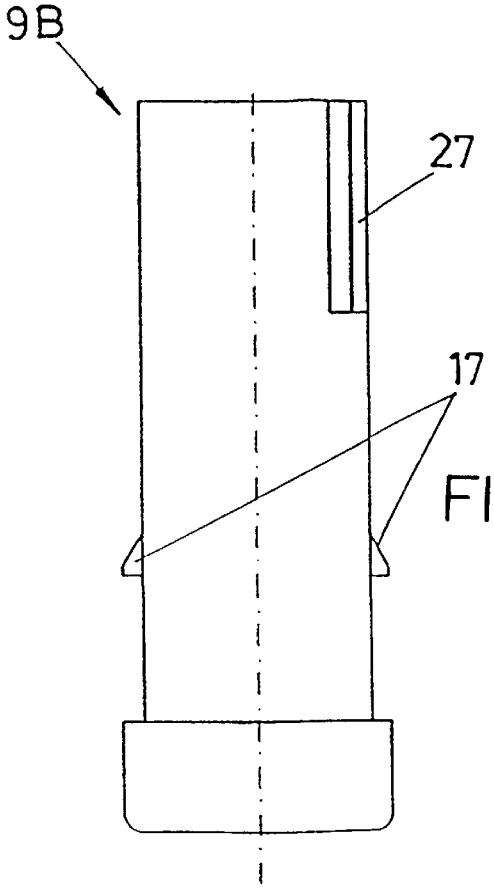
FIG. 24 is a side elevation view of what is shown in FIG. 22.
Figure 25:
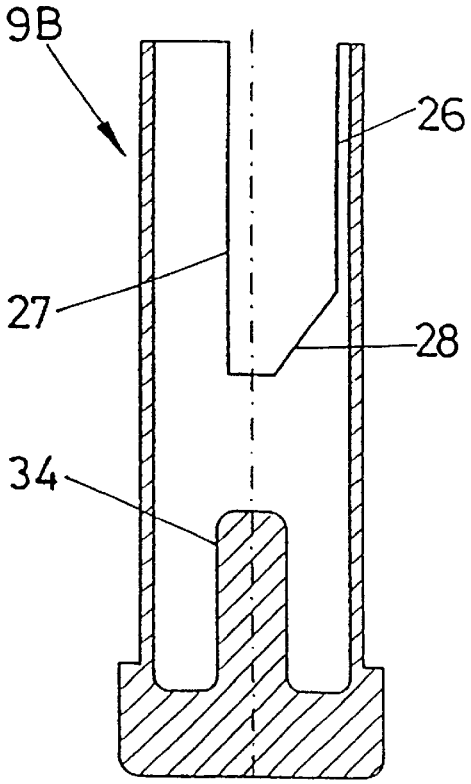
FIG. 25 is a longitudinal elevation section of the cover of FIG. 22.

In FIG. 17 may be seen a sectioned longitudinal elevation view of body 2C and its lower cover 9B after being coupled, by means of the teeth 17 being introduced inside the corresponding windows 18.

The recovery ramps may be observed in FIG. 20, that is to say, the first ramps or upper ramps 25, as well as axial cavity 24 through which the cylindrical part of the interior upper body 1 is introduced. In FIG. 19, the seating surface of helicoidal spring 5 which assists the telescopic assembly, is referenced with number 35.

Figure 26:
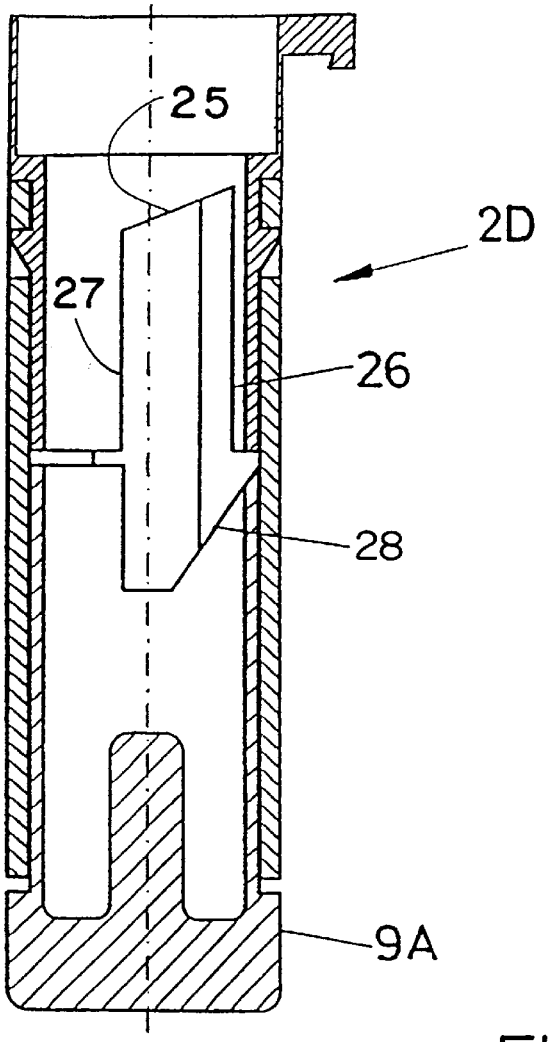
FIG. 26 is a sectioned longitudinal elevation view, similar to FIG. 17, of a fourth embodiment of the invention.
Figure 27:
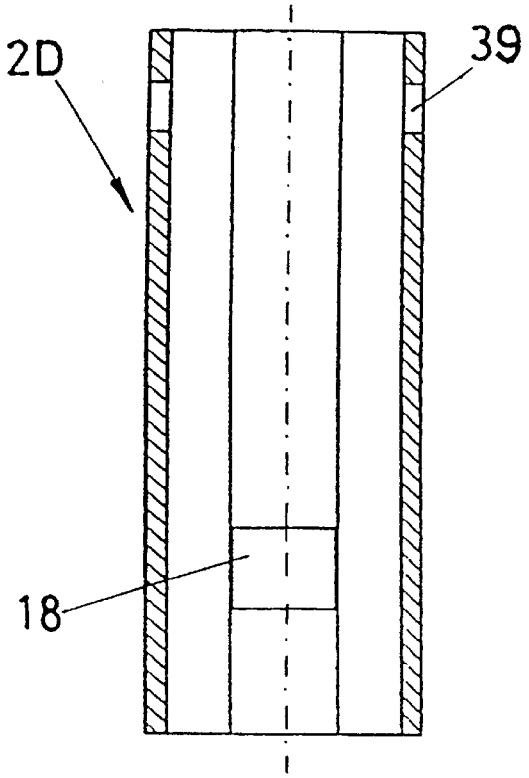
FIG. 27 is a sectioned longitudinal elevation view of the central part of the exterior telescopic body of FIG. 26.
Figure 28:
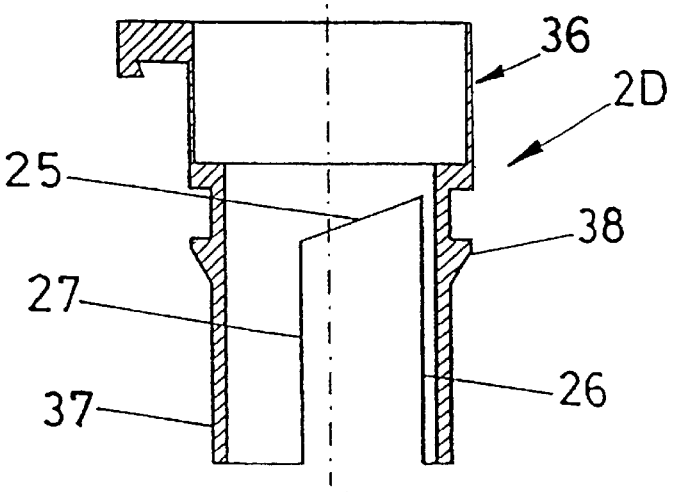
FIG. 28 is a sectioned longitudinal elevation view of the upper part of the same telescopic body as the one in FIG. 26, which will remain connected to the upper mouth of the central part of the same.

In the embodiment represented in FIGS. 26 through 28, the exterior telescopic body is referenced generally with number 2D and it may be observed that its section corresponds with representation in FIG. 21, throughout all its length. On its lower part, cover 9A is coupled and, through its upper mouth, the detachable and independent part, carrier of a quadrangular neck 37, said neck being provided with teeth 28 for its interlocking with the windows 39 of the main portion of said body 2D, similar to the interlocking of cover 9A.

It may be clearly seen in FIG. 28, how the upper ramps 25 and the vertical sections 26 and 27 of longitudinal hollows 32, are performed on neck 37 of said upper detachable part 36. The lower ramps 28 are to be found on the upper edge of lower cover 9A.

Figure 29:
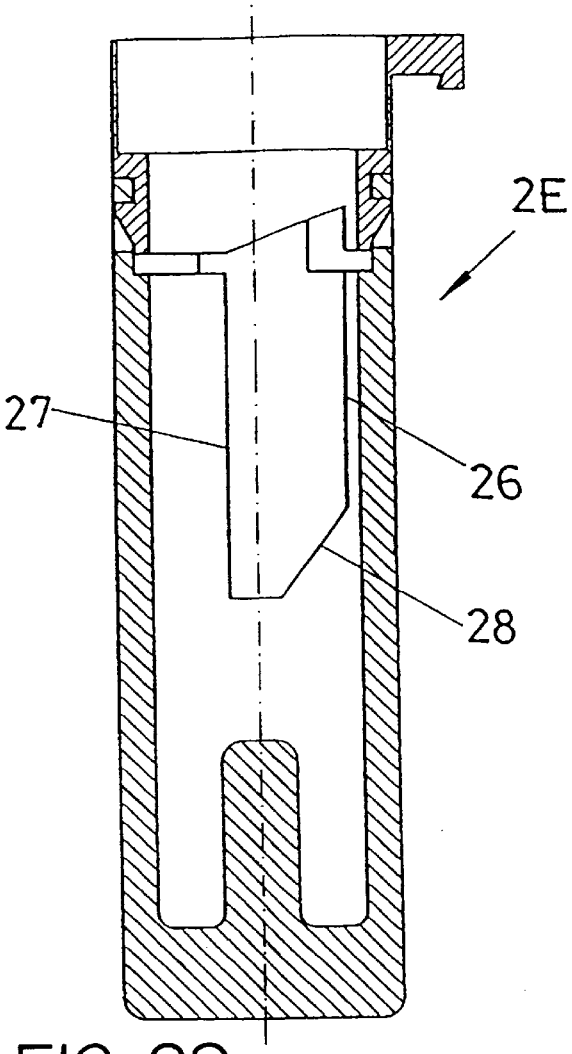
FIG. 29 is a longitudinal elevation view, similar to FIG. 17, according to a fifth embodiment of the invention.
Figure 30:
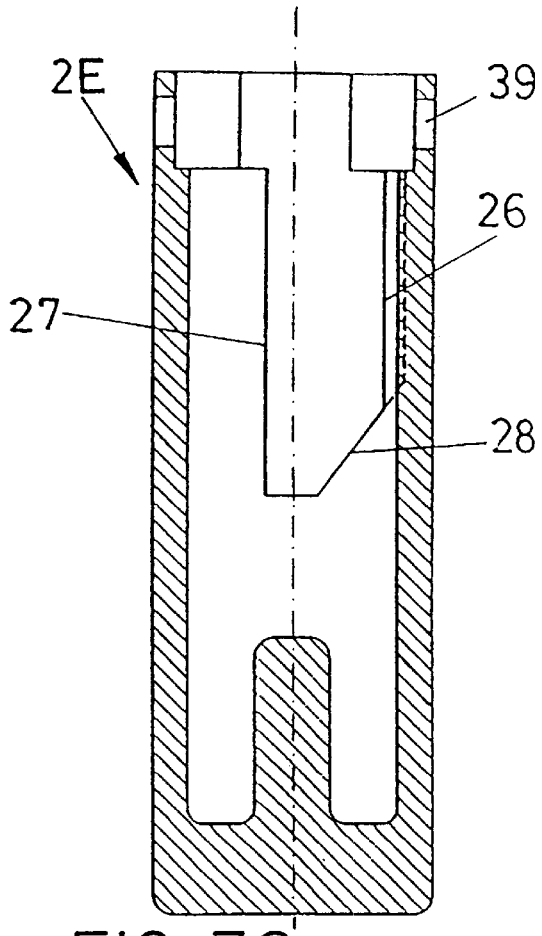
FIG. 30 is a sectioned longitudinal elevation view of the lower part of the exterior telescopic body of FIG. 29.
Figure 31:
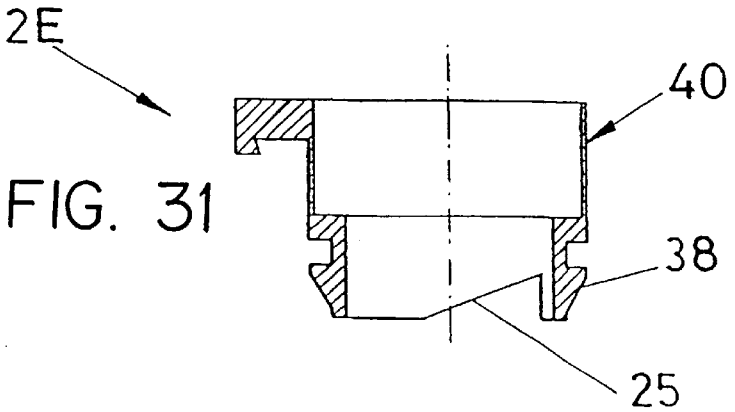
FIG. 31 is a sectioned longitudinal elevation view of the upper part of the same body of FIG. 29, which shall remain connected to the mouth of the remaining part of the same exterior telescopic body of FIGS. 29 and 30.

Finally, making special reference herewith to FIGS. 29 through 31, in which is represented a fifth embodiment of the invention, the exterior telescopic body is referenced generally with 2E, having a detachable upper part 40 which is locked to the rest of the body in like manner as described in relation to the embodiment of FIGS. 26 through 28, though in this case, the neck, carrier of teeth 38, is of very short length since it only includes the first ramps or upper ramps 25. The rest of the main body 2E, made up of one single part, since it is not necessary that the lower part be also detachable, includes the seconds ramps or lower ramps 28 and the guides or vertical edges 26 and 27 of the longitudinal hollows for activation on the striker.

Hereinafter all the references used in the description and which correspond to the following elements are correlatively numbered:

1—First telescopic body according to a conventional embodiment.
1A—First telescopic body according to an embodiment of the invention.
2—Second telescopic body according to a conventional embodiment.
2A–2E—Second telescopic body, or exterior telescopic body according to different embodiments.
3—Conventional striker.
4—Conventional diametrical projections of the striker.
5—Conventional recovery spring.
6—Longitudinal grooves of interior telescopic body 1.
7—Longitudinal legs of interior telescopic body
8—Release spring.
9–9B—Closing cover of the lower mouth of the telescopic body 2.
10—Upper recovery ramps, or first ramp.
11—Vertical guiding section.
12—Lower release ramp, or second ramp.
13—Vertical guiding section.
14—Anvil.
15—First electrode.
16—Pushbutton.
17—Projection of the cover.
18—Complementary windows of exterior body.
19—Angular part, integral with interior telescopic body 1.
20—Opening cam of the gas valve.
21—Gas valve.
22—Second lighting electrode.
23—Lighter shell.
24—Axial cavity of the exterior telescopic body.
25—Upper ramp of the hollows for activation and guiding of the striker.

26—Vertical edge of the hollows
27—Vertical edge of the hollows
28—Lower ramp of the hollows
29—Side notches of legs 7.
30—Chamfers of the free end the legs 7.
31—Splines of exterior body 2B.
32—Hollows for activation and guiding of the striker.
33—Cylindrical hollow of the cover.
34—Coaxial spigot of the cover.
35—Seating surface of spring 5.
36—Upper detachable part of body 2D.
37—Neck of upper part 36.
38—Teeth.
39—Window.
40—Upper detachable part of exterior telescopic body 2E.

We claim:

1. A piezoelectric mechanism which comprises:

a first telescopic body, which is partially inserted into an end of a second telescopic body, said second body comprising a first base through which is inserted a first end of said first body, and a second base, axially opposed to said first base;

a first spring which keeps said first body separated from said second body at a predetermined distance, in the rest position of the mechanism;

a piezoelectric element housed in one of the bodies;

a substantially cylindrical striker with diametrically opposed side projections housed in an axially moveable manner in an axial cavity of the other body and retained in a first position at a determined distance from the piezoelectric element by retention means associated to said telescopic bodies;

a second spring for impelling the striker against the piezoelectric element;

releasing means of the striker from its rest position, associated to said telescopic bodies, on application of a compressing force in the piezoelectric mechanism, said releasing means being arranged in a zone of the axial cavity which presents a nonquadrangular cross section, being said striker retention means, functionally complementary to said releasing means, provided in said telescopic bodies;

the striker being axially guided, since the first telescopic body is provided with an axial groove which divides its interior end into two legs, in which play diametrical projections of the striker, said legs being each provided with side notches for the retention of said side projections, characterized in that the releasing means of the second telescopic body in which the striker is housed, are located inside said second body, said second body having at least one open end, and comprise two longitudinal hollows, said longitudinal hollows being located in internal walls of said second telescopic body without opening through said walls, formed in inverted mirror image on opposite walls of said axial cavity;

each one of the hollows being delimited by:

one first inclined and curved ramp for guiding the projections of the striker towards a rest position on a first end of said first ramp, at a first distance from the piezoelectric element;

a first straight axial guide, with a first end, adjacent to the first end of the first ramp for axially guiding the striker towards a releasing position for the release on a second end, which is at a greater distance from the piezoelectric element than said first distance;

a second straight axial guide with a first end adjacent to a second end of the first ramp, for axially guiding the striker during the release against said piezoelectric element towards said first ramp;

and a second ramp, axially opposed to the first ramp and inclined substantially in the same direction and with equal curvature to that of the first ramp for causing the releasing of the striker by actuation on the diametrical projections of said striker, having said second ramp a first end, adjacent to said second end of the first guide and a second end, adjacent to a second end of the second guide, for guiding the striker from said second end of the first guide towards a position in which the striker is axially more distanced from the first base of said second body, in said second end of said second guide in which position, the striker is released for the release.

2. Piezoelectric mechanism, according to claim 1, characterized in that said axial cavity comprises a first cylindrical section which extends from the first base of the second telescopic body up to at least the transversal plane corresponding to the location of the second end of the second guide of hollows.

3. Piezoelectric mechanism, according to claim 2, characterized in that the axial cavity presents a second section with quadrangular cross section, from said transversal plane up to said second base of the second telescopic body.

4. Piezoelectric mechanism, according to claim 3, characterized in that said quadrangular cross section presents diagonals which are longer than the diameters of said first cylindrical section, sufficiently long to form a passage through which the diametrical projections of the striker are guided, from said second base of the second telescopic body.

5. Piezoelectric mechanism, according to claim 2, characterized in that the axial cavity presents a second cylindrical section with circular cross section, from said transversal plane up to the second base of the second telescopic body.

6. Piezoelectric mechanism, according to claim 5, characterized in that the diameter of said second cylindrical section is greater than the diameter of said first cylindrical section of said axial cavity.

7. Piezoelectric mechanism, according to any of claims 1 through 6, characterized in that the second telescopic body presents two splines, in central wall sections, which extend from the second base of the exterior telescopic body up into the respective hollow.

8. Piezoelectric mechanism, according to claim 1, characterized in that said second ramps, are provided on a part made up of a cover inserted on the lower base of the second telescopic body in the axial cavity, the cross section of said axial cavity being complimentary with the exterior cross section of said cover.

9. Piezoelectric mechanism, according to claim 7, characterized in that the surfaces of the free ends of said longitudinal legs are essentially flat.

10. Piezoelectric mechanism, according to claim 1, characterized in that the first ramps and/or the axial guides are established on an independent portion of the second telescopic body, which is capable of connection with the rest of the body.

11. Piezoelectric mechanism, according to claim 10, characterized in that the axial guides, jointly with the second ramps are included in two opposed walls of a cover which closes the mouth of the second body from below, the cover being equipped with a tubular portion which penetrates through said mouth and which is provided with two notches in the edge of two of its opposed side walls, the upper end of said cover practically reaching the lower end of the first ramps.

12. Piezoelectric mechanism, according to claim 10, characterized in that the second telescopic body has an upper part which is detachable and independent from the lower part, joining the same since it is provided with a tubular extension which is introduced through the upper mouth of said lower part, equipped with mutual interlocking means.

13. Piezoelectric mechanism, according to claim 12, characterized in that it includes in two external opposed points of the side walls of said upper detachable part, teeth which are interlocked in corresponding windows of the side walls of said interior part of the second body, or viceversa.

14. Piezoelectric mechanism, according to any of the claims 12 or 13, characterized in that the upper and independent part of the second telescopic body, includes the first ramps and the vertical guides, its internal mouth practically reaching the edge of the cover which closes the mouth of the second body from below, equipped with a penetrating tubular portion which is provided with two notches in the edge of two of its opposed sides, thus establishing the second ramps.

15. Piezoelectric mechanism, according to any of the claims 12 or 13, characterized in that the upper and independent part of the second telescopic body includes the first ramps, its internal mouth practically reaching the initial end of the guides or longitudinal edges of said second body, in which also the second ramps are established.

16. A piezoelectric mechanism for a gas lighter, comprising:

a first telescopic body having at least one open end;

a piezoelectric element mounted in said first telescopic body;

an electrode for delivering a spark being mounted on said first telescopic body;

a second telescopic body having at least one open end and an outer wall surface, said second telescopic body being slidably coupled with said first telescopic body such that said at least one open end of said second telescopic body mates with said at least one open end of said first telescopic body, said outer wall surface being substantially unbroken without openings there through;

a substantially cylindrical striker mounted in an axially moveable manner in said second telescopic body; and at least one spring for biasing said substantially cylindrical striker into contact with said piezoelectric element thereby generating a spark being delivered by said electrode.

17. The mechanism of claim 16 wherein said second telescopic body further comprises an inner wall surface defining hollows formed in said inner wall surface.

18. The mechanism of claim 17 where in said hollows provide guides and said striker includes extending lugs received in said guides to guide the striker within said first telescopic body and said second telescopic body.

* * * * *